United States Patent [19]

Belentepe et al.

[11] 4,029,898

[45] June 14, 1977

[54] TELEVISION PICTURE TUBE FACE PLATE

[75] Inventors: Yilmaz C. Belentepe, Corning; Wendell S. Blanding, Painted Post, both of N.Y.

[73] Assignee: Corning Glass Works, Corning, N.Y.

[22] Filed: Mar. 24, 1976

[21] Appl. No.: 670,046

[52] U.S. Cl. ..... 358/247; 220/2.1 A; 220/2.3 A

[51] Int. Cl.[2] ..... H01J 5/02; H01J 29/02

[58] Field of Search ..... 178/7.8, 7.82, 7.85; 220/2.1 A, 2.3 A; 313/477–482, 402–408

[56] References Cited

UNITED STATES PATENTS

| | | | |
|---|---|---|---|
| 2,618,759 | 11/1952 | Hayt | 220/2.1 A |
| 2,728,012 | 12/1955 | Swedlund | 220/2.1 A |
| 2,785,821 | 3/1957 | Vermaas | 220/2.3 A |
| 2,799,422 | 7/1957 | Hagenberg | 220/2.3 A |
| 2,966,997 | 1/1961 | Stutske | 220/2.1 A |
| 3,508,310 | 4/1970 | Eisses | 178/7.82 |
| 3,605,227 | 9/1971 | Nienhists | 220/2.1 A |
| 3,720,345 | 3/1973 | Logue | 220/2.1 A |

*Primary Examiner*—Robert L. Griffin
*Assistant Examiner*—Edward L. Coles
*Attorney, Agent, or Firm*—Charles W. Gregg; Burton R. Turner; Clarence R. Patty, Jr.

[57] ABSTRACT

A television picture tube face plate or viewing panel including a viewing area having a reduced thickness for weight reduction of the face plate or viewing panel and resultant savings in the quantity of glass required in the manufacture of such a face plate. A thickened annular area of the face plate, adjacent and surrounding the outer perimeter thereof, is preferably provided with a selected maximum thickness at or adjacent the ends of the minor axis of the face plate, a selected minimum thickness at or adjacent the diagonal axis of the face plate and an intermediate thickness at or adjacent the ends of the major axis of the face plate, the regions of the face plate at or adjacent such ends of said axes being the regions of the face plate having the greatest, least and intermediate stresses, respectively, when the face plate is part of an exhausted television picture tube.

8 Claims, 7 Drawing Figures

TELEVISION PICTURE TUBE FACE PLATE

BACKGROUND OF THE INVENTION

For the purpose of uniform brightness and lack of distortion of a picture displayed by a television picture tube, it is highly desirable that the face plate or viewing panel of such a tube have, in the viewing or picture display area thereof, a uniform thickness. There is disclosed, for example, in copending application, Ser. No. 579,883, filed May 22, 1975 by Lawrence B, Hausheer and assigned to the same assignee as the present application, a television picture tube envelope including a face plate having, at least in the viewing area thereof, a substantially uniform thickness throughout such area. It is now known that stresses across the face plate of television picture tubes are greatest at the ends of the minor axis of the face plate, least at the ends of the diagonal axis thereof and of an intermediate value at the ends of the major axis of the face plate. Accordingly, in order to reduce the weight of a television picture tube and attain an economic advantage by the saving of the quantity of glass used in manufacturing the face plate of such a tube, the present invention, using a reduced quantity of glass in the viewing area of a television picture tube face plate was developed, such a reduction in such quantity of glass used being attained by a reduction in the thickness of the glass in said viewing area which is found to be possible due to a minimum stress in the glass of such area.

It is, therefore, an object of the present invention to provide a novel face plate or viewing panel for a television picture tube or tube envelope, such face plate having a configuration such that a lesser quantity of glass than normally used may be used in the manufacture thereof and a lighter weight face plate thereby provided.

It is another object of the present invention to provide a novel face plate or viewing panel for a television picture tube or tube envelope, such face plate providing an economic advantage due to savings in the quantity of glass required for manufacture of the face plate or viewing panel.

Other objects and characteristic features of the invention will become apparent as the description proceeds.

SUMMARY OF THE INVENTION

The invention is believed to be adequately summarized in the foregoing abstract of the disclosure and, therefore, to prevent repetition or redundancy to the extent possible, no further summary of the invention will be given nor is any believed necessary.

BRIEF DESCRIPTION OF THE DRAWINGS

In the Drawings.

Similar reference characters refer to similar parts in each of the figures of the drawings.

PREFERRED EMBODIMENTS OF THE INVENTION

Figure 1:
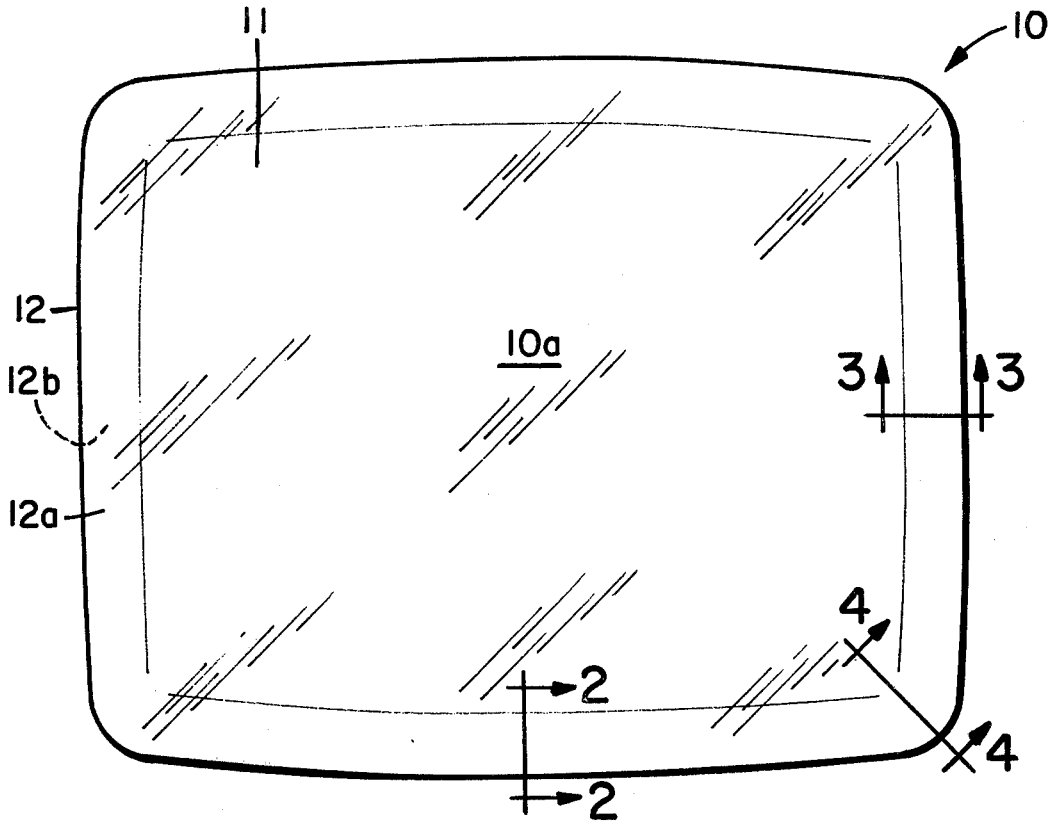
FIG. 1 is a top plan view of a skirtless television picture tube face plate embodying the invention.

Referring to FIGS. 1 through 4 of the drawings in detail, there is shown in FIG. 1 the outer or outside surface of a face plate 10 for a television picture tube or tube envelope and embodying the invention, such face plate including a viewing area 11 of substantially uniform thickness and an annular area 12 adjacent to or abutting such viewing area and surrounding the outer perimeter of the viewing area. Annular area 12 has a generally greater thickness than said viewing area and, at the ends of the minor axis of the face plate, has at least a thickness sufficient to withstand the stress developed across the face plate 10 when it is made part of a television picture tube and such tube is exhausted, said ends of the minor axis being the regions of the face plate having the greatest stress in an exhausted picture tube. In an exhausted picture tube the stress in the regions of the ends of the diagonal axis of the face plate is the minimum stress and the stress in the regions of the ends of the major axis of the face plate is of a value intermediate those at the ends of said minor and diagonal axes.

As illustrated in FIGS. 1 through 4 said annular area 12 of face plate 10 is preferably, but not necessarily, of uniform width around the perimeter of such area and the outer or outside surface 10*a* of the face plate is preferably uniformly convexly curved, at least in said viewing area 11. Therefore, the annular area 12 of greater thickness than said viewing area 11 is preferably made thicker only at the inside or inner surface 12*b* of such annular area, the outside or outer surface 12*a* of such area being continuous with the outer or outside surface of viewing area 11 to provide the aforesaid preferred uniformly convexly curved outer or outside surface 10*a* of face plate 10. This is best understood with reference to FIGS. 2, 3 and 4 of the drawings which illustrates face plate 10 sealed to the sealing edge of a funnel member 9 of a picture tube.

Figure 2:
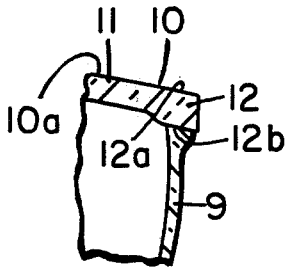
FIGS. 2, 3 and 4 are cross-sectional views of part of the face plate of FIG. 1 shown sealed to the seal edge of part of a funnel member for said tube, such views being taken along lines 2—2, 3—3 and 4—4, respectively, of FIG. 1.
Figure 3:
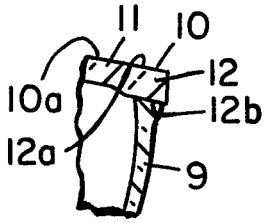
Figure 4:
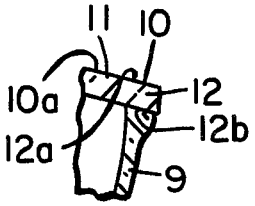

As previously mentioned, the stress in the regions of the ends of the minor axis of a face plate such as 10 are, when such face plate is part of an exhausted television picture tube, of a greater value than any other regions of such a face plate and, therefore, by a comparison of FIGS. 2, 3 and 4, the thickness of annular area 12 at the ends of said minor axis (FIG. 2) is preferably and is shown as greater than the thickness of such annular area at the ends of the major and diagonal axes (FIGS. 3 and 4, respectively) of face plate 10. The thickness of annular area 12 in the regions of the ends of the major and diagonal axes of face plate 10 could be the same as that in the regions of the ends of the minor axis but, since such a thickness is not required by the stresses at the ends of the major and diagonal axis, annular area 12 preferably diminishes in thickness substantially uniformly from the ends of said minor and major axes towards the ends of said diagonal axis. The thickness of annular area 12 at the ends of the diagonal axes of face plate 10 may, for example, be generally equal to the thickness of viewing area 11 of the face plate and the thickness of such annular area at the ends of the major axis of face plate 10 (FIG. 3) may, for example, be intermediate the thickness of the annular area at the ends of the minor or diagonal axes shown in FIGS. 2 and 4, respectively.

Figure 5:
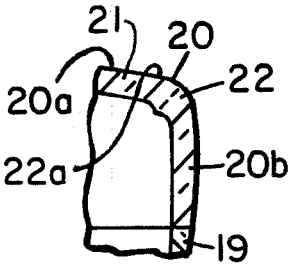
FIGS. 5, 6 and 7, are cross-sectional views of part of another type of television picture tube face plate also embodying the invention, such views being similar to cross-sectional views 2, 3 and 4, respectively, but being cross-sectional views taken along the minor, major and diagonal axes, respectively, of part of a conventional skirted television picture tube face plate and funnel member.
Figure 6:
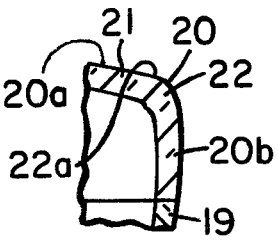
Figure 7:
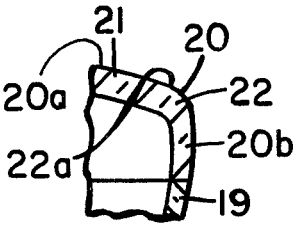

Referring now to FIGS. 5, 6 and 7, there is shown part of a face plate 20 of a conventional skirted type of television picture tube envelope including part of a funnel member 19 to the sealing edge of which is sealed the sealing edge of a depending skirt portion 20*b* of face plate 20. Face plate 20 includes an annular area 22 adjacent or abutting and surrounding viewing area 21 of face plate 20 and which is similar to annular area 12 of face plate 10 of FIGS. 1 through 4. Thus, it may be said that reference characters 20, 20*a*, 21, 22, and 22*a* of FIGS. 5, 6 and 7 correspond or are similar to reference characters 10, 10*a*, 11, 12 and 12*a*, respectively, of FIGS. 1 through 4, that is, said reference characters of FIGS. 5, 6 and 7 designate parts of face plate 20 which correspond to the similar parts of face plate 10 designated by said respective reference characters of FIGS. 1 through 4, and the foregoing description of face plate 10 is generally equally applicable to face plate 20 of FIGS. 5, 6 and 7. Therefore no detailed description of the novel face plate 20 is believed to be necessary since the configuration of such face plate can be readily understood in the light of the detailed description of face plate 10 and, for purposes of brevity of the present application to the extent possible, no further detailed description of face plate 20 will be given.

As previously mentioned, by the use of an annular area such as 10 (or 20) adjacent or abutting and surrounding viewing area 11 (or 21) of a face plate such as 10 (or 20) the glass of said viewing area can be substantially reduced in thickness and economic advantages are attained over a face plate of generally uniform thickness such as disclosed in aforesaid patent application of L. B. Hausheer.

Although there is herein shown and described only two specific examples of a face plate or viewing panel embodying the invention disclosed, it is to be understood that such is not to be considered in any way limiting but that various changes and modifications may be made therein within the purview of the appended claims without departing from the spirit and scope thereof.

What is claimed is:

1. A face plate for a television picture tube envelope, such face plate having a uniformly convexly curved outside surface and comprising;

A. a viewing area of a generally uniform thickness throughout the areal expanse thereof;

B. adjacent to and surrounding the outer perimeter of said viewing area an annular area of a generally greater thickness than said viewing area and of a generally uniformly diminishing thickness, such annular area including, I. a region of maximum thickness at the ends of the minor axis of the face plate, II. a region of minimum thickness at the ends of the diagonal axis of the face plate, and III. a region of intermediate thickness at the ends of the major axis of the face plate.

2. A face plate in accordance with claim 1 and in which said annular area of the face plate is of a generally uniform width about the perimeter of such area.

3. A face plate in accordance with claim 1 and in which such face plate is a skirtless face plate.

4. A face plate in accordance with claim 2 and in which such face plate is a skirtless face plate.

5. A face plate in accordance with claim 1 and in which such face plate is a skirted face plate.

6. A face plate in accordance with claim 2 and in which such face plate is a skirted face plate.

7. In a television picture tube envelope, the improvement comprising;

A. a face plate having a uniformly convexly curved outer surface and including a viewing area of a generally uniform thickness throughout the areal expanse thereof, and B. an annular area abutting and surrounding the outer perimeter of said viewing area, such annular area having;

I. at the ends of the minor axis of said face plate, a thickness greater than said viewing area;

II. at the ends of the diagonal axis of said face plate, a thickness generally equal to the thickness of said viewing area; and III. at the ends of the major axis of said face plate, a thickness intermediate said thicknesses at the ends of said minor and diagonal axes;

IV. said annular area generally uniformly diminishing in thickness from the ends of said minor and major axes towards the ends of said diagonal axis.

8. A face plate in accordance with claim 7 and in which said annular area of the face plate is of a generally uniform width around the perimeter of such area.

* * * * *